US007897316B2

(12) United States Patent
Yamazaki et al.

(10) Patent No.: US 7,897,316 B2
(45) Date of Patent: Mar. 1, 2011

(54) TONER HAVING HYBRID BINDER RESIN WITH POLYESTER UNIT AND VINYL COPOLYMER UNIT

(75) Inventors: Katsuhisa Yamazaki, Numazu (JP); Masami Fujimoto, Sunto-gun (JP); Shuichi Hiroko, Susono (JP); Masaaki Taya, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 631 days.

(21) Appl. No.: 11/459,616

(22) Filed: Jul. 24, 2006

(65) Prior Publication Data

US 2007/0026336 A1 Feb. 1, 2007

(30) Foreign Application Priority Data

Aug. 1, 2005 (JP) ..... 2005-223298

(51) Int. Cl.
*G03G 9/087* (2006.01)

(52) U.S. Cl. ..... 430/109.3; 430/109.4

(58) Field of Classification Search ..... 430/109.3, 430/109.4

See application file for complete search history.

(56) References Cited

U.S. PATENT DOCUMENTS

| | | | | | |
|---|---|---|---|---|---|
| 2,297,691 | A | | 10/1942 | Carlson | 95/5 |
| 5,240,805 | A | * | 8/1993 | Asada et al. | 430/109.3 |
| 5,268,248 | A | | 12/1993 | Tanikawa et al. | 430/106 |
| 5,310,812 | A | * | 5/1994 | Yasuda et al. | 430/109.3 |
| 5,342,722 | A | * | 8/1994 | Ito et al. | 430/109.4 |
| 5,406,357 | A | | 4/1995 | Nakahara et al. | 355/245 |
| 5,447,813 | A | | 9/1995 | Hagiwara et al. | 430/106.6 |
| 5,716,746 | A | | 2/1998 | Mikuriya et al. | 430/106.6 |
| 5,744,276 | A | * | 4/1998 | Ohno et al. | 430/109.3 |
| 5,955,234 | A | * | 9/1999 | Matsunaga et al. | 430/109.3 |
| 5,962,176 | A | * | 10/1999 | Ohno et al. | 430/109.3 |
| 5,976,752 | A | | 11/1999 | Matsunaga et al. | 430/110 |
| 6,187,496 | B1 | | 2/2001 | Tanikawa et al. | 430/106.6 |
| 6,670,087 | B2 | | 12/2003 | Fujikawa et al. | 430/109.2 |
| 7,147,981 | B2 | | 12/2006 | Fujikawa et al. | 430/109.2 |
| 2005/0106485 | A1 | | 5/2005 | Yamazaki et al. | 430/109.3 |

FOREIGN PATENT DOCUMENTS

| | | | | |
|---|---|---|---|---|
| EP | 354466 | A1 | * | 2/1990 |
| EP | 462785 | A2 | * | 12/1991 |
| EP | 479275 | A1 | * | 4/1992 |
| EP | 589706 | A1 | * | 3/1994 |
| EP | 0 898 204 | A1 | | 2/1999 |
| EP | 1 096 326 | A2 | | 5/2001 |
| EP | 1 205 810 | A2 | | 5/2002 |
| JP | 42-023910 | | | 11/1967 |
| JP | 43-024784 | | | 10/1968 |
| JP | 11-194536 | | | 7/1999 |
| JP | 2000-056511 | | | 2/2000 |
| JP | 2001-013720 | | | 1/2001 |

OTHER PUBLICATIONS

European Search Report, Mar. 13, 2009 in EP 06 11 7508, 4 pages.

* cited by examiner

*Primary Examiner*—Christopher RoDee
(74) *Attorney, Agent, or Firm*—Fitzpatrick, Cella, Harper & Scinto

(57) ABSTRACT

Provided is a toner including at least: a binder resin; and a colorant, in which: the binder resin contains at least a polyester unit and a vinyl copolymer unit; a main peak MpA is present in the molecular weight region of 2,000 to 7,000 in a molecular weight distribution measured by means of gel permeation chromatography (GPC) of a specific tetrahydrofuran (THF) soluble matter A measured by a specific method; a main peak MpB is present in the molecular weight region of 5,000 to 10,000 in a molecular weight distribution measured by means of GPC of a specific THF soluble matter B which contains a component of a molecular weight region of 100,000 or less in range from 70 to 100 mass %, and the peak molecular weight MpA of the THF soluble matter A and the peak molecular weight MpB of the THF soluble matter B satisfy a specific equation.

3 Claims, No Drawings

TONER HAVING HYBRID BINDER RESIN WITH POLYESTER UNIT AND VINYL COPOLYMER UNIT

BACKGROUND OF THE INVENTION

1. Field of the Invention

The present invention relates to a toner for use in, for example, an image forming method and a toner jet method each intended for visualizing an electrophotograph, that is, an electrostatic charge image.

2. Description of the Related Art

A large number of image forming methods such as electrophotographic methods, that is, electrostatic recording methods, magnetic recording methods, and toner jet methods have been conventionally known. For example, such methods as described in U.S. Pat. No. 2,297,691, JP 42-23910 B, and JP 43-24748 B have been known as electrophotographic methods. A general electrophotographic method involves: utilizing a photoconductive substance; forming an electrostatic latent image on a photosensitive member by using various means; developing the latent image with toner to provide a visible image; transferring the toner onto a transfer material such as paper as required; and fixing the toner image onto the transfer material by using heat, pressure, or the like to provide a copied article. The toner remaining on the photosensitive member without being transferred is cleaned by means of various methods, and then the above steps are repeated.

In recent years, reductions in size and weight of a copying device for use in such electrophotographic method and improvements in speed and reliability (such as high definition or high image quality) of the device have been stringently pursued. For example, the copying device, which has been heretofore used as a copying machine for use in paper work for copying a mere original manuscript, starts to be used as a digital printer serving as the output of a computer or as a printer for copying a highly fine image such as a graphic design, and to be used for light printing where improved reliability is requested (a print-on-demand application where many kinds can be printed each in a small amount, the application ranging from the editing of a document by using a personal computer to the copying and binding of the document). Accordingly, improved image quality including improved definition has been requested. As a result, performance requested for toner has become more and more sophisticated.

Conventionally, each of a polyester unit and a vinyl copolymer unit such as a styrene resin has been mainly used as a resin for toner. The polyester unit originally has excellent low-temperature fixability, but involves a disadvantage in that an offset phenomenon at a high temperature is liable to occur. When one attempts to increase the molecular weight of the polyester unit to increase a viscosity in compensation for the disadvantage, low-temperature fixability is impaired, and grindability upon toner production degrades. Accordingly, the increase does not qualify for a reduction in particle size of toner.

In addition, the vinyl copolymer unit such as a styrene resin is excellent in grindability upon toner production, and is excellent in hot offset resistance because the molecular weight of the unit can be easily increased. However, a reduction in molecular weight of the unit with a view to improving low-temperature fixability degrades blocking resistance and developability.

A possible way to compensate for the disadvantages of those two kinds of resins while making effective use of the advantages of the resins relates to use the polyester unit and the vinyl copolymer unit as a mixture. However, mere mixing of them provides toner having a narrow fixation region because compatibility between them is insufficient. Moreover, the mixing degrades blocking resistance and developability.

JP 11-194536 A and JP 2000-56511 A each disclose a toner using at least two kinds of resins out of a polyester resin, a styrene resin, and a resin obtained as a result of a reaction between part of a styrene resin and a polyester resin. In each of those methods, compatibility between the polyester resin and the styrene resin improves, and toner having a wide fixation temperature region can be obtained. However, the performance of the toner is not yet sufficient in a machine that has realized a fixation method requested in recent years with which copying can be performed at a high speed and a low power consumption. That is, an increase in copying speed shortens a time period for which a recording material passes through a fixing unit even when a heating temperature or applied pressure upon fixation is comparable to a conventional one. In other words, the total quantity of heat (work done) to be applied to the recording material is liable to reduce, so an additional improvement in fixability of toner is indispensable.

Furthermore, JP 2001-13720 A discusses the properties of a polymer that does not affect fixation through the specification of a difference between the amount of soluble matter and the amount of insoluble matter in each of different solvents with regard to a toner component, as a result, discloses a technique for producing toner with which a wide fixation region can be obtained. Although the method can provide a resin design that hardly inhibits fixability, a wait time is short. Accordingly, the resin design must be additionally improved so that a fixation method requiring a low power consumption is realized.

SUMMARY OF THE INVENTION

An object of the present invention is to provide a toner that has solved by the above problems. That is, an object of the present invention is to provide a toner which: enables low-temperature fixation irrespective of the constitution of a fixing unit; is excellent in offset resistance and storage stability; stably provides high image quality even when the toner is used at a high humidity or a low humidity; and does not cause any image failure with time.

The present invention relates to a toner including at least: a binder resin; and a colorant, characterized in that: the binder resin contains at least a polyester unit and a vinyl copolymer unit, a main peak MpA is present in a molecular weight region of 2,000 to 7,000 in a molecular weight distribution measured by means of gel permeation chromatography (GPC) of a tetrahydrofuran (THF) soluble matter A when the toner is extracted through Soxhlet extraction with THF for 16 hours, a main peak MpB is present in a molecular weight region of 5,000 to 10,000 in a molecular weight distribution measured by means of GPC of a THF soluble matter B when the toner is left in a THF solvent at 25° C. for 24 hours, and the THF soluble matter B contains a component of a molecular weight region of 100,000 or less in range from 70 to 100 mass %, and a peak molecular weight MpA of the THF soluble matter A and a peak molecular weight MpB of the THF soluble matter B satisfy the following equation: $0.50<MpA/MpB<0.95$.

Further in the toner of the present invention, a containing ratio of the polyester unit to the vinyl copolymer unit in the binder resin preferably is 50/50 to 90/10 (mass ratio).

Further in the toner of the present invention, the polyester unit preferably includes, as a monomer, at least one kind selected from the group consisting of adipic acid, maleic acid, alkenylsuccinic acid, fumaric acid, and acid anhydrides of the acids.

Further in the toner of the present invention, the binder resin preferably includes a hybrid resin in which the polyester unit and the vinyl copolymer unit are chemically bound to each other.

Further in the toner of the present invention, the hybrid resin preferably is obtained by polymerizing the vinyl copolymer unit on a first stage and reacting the vinyl copolymer unit and an unsaturated polyester unit on a second stage using a bifunctional polymerization initiator having reactive groups different from each other in decomposition temperature.

Further in the toner of the present invention, the bifunctional polymerization initiator preferably has the following structure:

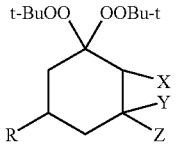

where t-Bu represents a t-butyl group, and X, Y, Z, and R each independently represent one selected from the group consisting of hydrogen, a methyl group, an ethyl group, a propyl group, an-butyl group, anisopropyl group, anisobutyl group, and a t-butyl group.

Further in the toner of the present invention, the bifunctional polymerization initiator preferably includes one kind selected from the group consisting of 1,1-bis(t-butylperoxy)-2-methylcyclohexane, 1,1-bis(t-butylperoxy)-2-n-butylcyclohexane, and 1,1-bis(t-butylperoxy)-3,3,5-trimethylcyclohexane.

According to the present invention, there is provided a toner in which: the binder resin in the toner contains at least a polyester unit and a vinyl copolymer unit; the main peak MpA is present in the molecular weight region of 2,000 to 7,000 in the molecular weight distribution measured by means of gel permeation chromatography (GPC) of the tetrahydrofuran (THF) soluble matter A when the toner is extracted through Soxhlet extraction with THF for 16 hours; the main peak MpB is present in the molecular weight region of 5,000 to 10,000 in the molecular weight distribution measured by means of GPC of the THF soluble matter B when the toner is left in the THF solvent at 25° C. for 24 hours; the THF soluble matter B contains a component of the molecular weight region of 100, 000 or less in range from 70 to 100 mass %; and the peak molecular weight MpA of the THF soluble matter A and the peak molecular weight MpB of the THF soluble matter B satisfy an equation $0.50<MpA/MpB<0.95$. A toner having such physical properties enables low-temperature fixation irrespective of the constitution of a fixing unit, is excellent in offset resistance and storage stability, stably provides high image quality even when the toner is used at a high humidity or a low humidity, and does not cause any image failure with time.

DETAILED DESCRIPTION OF THE INVENTION (1) Toner

The inventors of the present invention have conducted investigation into a component for use in toner, and have found that a low softening component effective for fixation can be effectively taken in a resin without the degradation of storage stability by: using a polyester unit and a vinyl copolymer unit having the constitutions of resin components in the toner, that is, a polyester unit and a vinyl-based copolymer unit at a specific mixing ratio; identifying the resin components as a high-softening temperature resin and a low-softening temperature resin depending on a molecular weight and using only the high-softening temperature resin, or preferably the high-softening temperature resin and the low-softening temperature resin at a specific mixing ratio; and controlling the structure of a highly crosslinked part (gel).

In addition, the inventors of the present invention have found that a highly crosslinked part capable of taking in a low softening component without degrading storage stability can be easily designed by producing a resin on two stages using a bifunctional polymerization initiator having each of groups different from each other in decomposition temperature.

In the toner of the present invention, it is desirable that: a binder resin in the toner contain at least a polyester unit and a vinyl copolymer unit; a main peak MpA be present in the molecular weight region of 2,000 to 7,000 (preferably 3,000 to 7,000)in a molecular weight distribution measured by means of gel permeation chromatography (GPC) of a tetrahydrofuran (THF) soluble matter A when the toner is extracted through Soxhlet extraction with THF for 16 hours; a main peak MpB be present in the molecular weight region of 5,000 to 10,000 in a molecular weight distribution measured by means of GPC of a THF soluble matter B when the toner is left in a THF solvent at 25° C. for 24 hours; the THF soluble matter B contains a component of the molecular weight region of 100,000 or less in range from 70 to 100 mass %; and the peak molecular weight MpA of the THF soluble matter A and the peak molecular weight MpB of the THF soluble matter B satisfy an equation $0.50<MpA/MpB<0.95$, or preferably $0.55<MpA/MpB<0.90$.

The fact that the peak molecular weight of THF soluble matter in toner changes in this way depending on the temperature at which extraction is performed means that the dissolution amount of the THF soluble matter of a binder resin component in the toner varies depending on a heat quantity. That is, this shows that a component serving as a soluble component is present in the toner because the entanglement of molecules is disentangled by an increase in temperature of a solvent. A component to be extracted from the toner of the present invention through Soxhlet extraction exerts a specific action in the toner of the present invention. That is, the component has an extremely low molecular weight and is a resin component having a low softening temperature, so the component tends to cause thermal behavior in a low temperature region, and hence low-temperature fixability can be improved.

The following has been found: as described above, low-temperature fixability largely depends on a component to be extracted at the boiling point of THF (Soxhlet extraction) from a resin, in particular, a highly crosslinked component; and in order to take the component in the resin without degrading storage stability, the peak molecular weight MpA of the THF soluble matter A of the toner and the peak molecular weight MpB of the THF soluble matter B of the toner must satisfy an equation $0.50<MpA/MpB<0.95$.

That is, the case where $MpA/MpB>0.95$ shows that nearly no resin component having a low molecular weight and a low softening temperature is extracted from a resin, in particular, a highly crosslinked component through Soxhlet extraction, or a component having a higher molecular weight is eluted by heat.

This shows that (1) the resin, in particular, the highly crosslinked component is not a component whose molecules are disentangled by heat, and is composed of an extremely hard component, or (2) the resin, in particular, the highly crosslinked component is a component whose molecules are disentangled by heat, but the amount of a resin component having a low molecular weight and a low softening temperature in the resin is not very large. In each of those cases, the amount of a component that tends to cause thermal behavior in a low temperature region reduces, so a half tone image and fixability to a cardboard degrade. Furthermore, in the case of the above item (1), fixability degrades, and the dispersibility of a colorant, a release agent, or the like cannot be improved, with the result that durable developability at a high temperature and a high humidity degrades. Furthermore, in such case, the amount of a component having strong brittleness relatively increases, so grindability is affected.

In addition, the case where MpA/MpB<0.50 shows that (3) the ratio of a component having a low molecular weight and a low softening temperature in the resin, in particular, the highly crosslinked component is large, or (4) the entanglement of the molecules of the resin, in particular, the highly crosslinked component is considerably disentangled by heat.

In each of those cases, fixability improves, but the amount of a resin, in particular, the highly crosslinked component, excellent in thermal stability, relatively reduces, so it becomes difficult to satisfy hot offset resistance. Furthermore, in the case of the above item (3), the amount of the component having a low molecular weight and a low softening temperature increases, so storage stability degrades. In addition, the amount of a component that is thermally unstable increases, so the toner is vulnerable to a mechanical shear, and the deterioration of the toner is apt to progress. As a result, it becomes difficult to obtain image quality stably for a long time period. In addition, in the case of the above item (4), flexibility provided by entanglement is present and nearly no viscous component is present, so adhesiveness to a transfer material weakens. The toner can withstand abrasion, however, the toner tends to be weak against peeling. In particular, the toner is apt to peel off a transparency. Furthermore, a kneading shear at the time of melting and kneading upon production of toner particles caused by the resin, in particular, the highly crosslinked component cannot be applied, so the dispersibility of a raw material such as a release agent, a magnetic material, or a charge control agent into the toner particles degrades, and developability is affected.

In the present invention, when the peak top molecular weight MpA of the main peak of the THF soluble matter A of the toner is smaller than 2,000, fixability improves, but the amount of a resin, in particular, a highly crosslinked component, excellent in thermal stability, relatively reduces, so it becomes difficult to satisfy hot offset resistance. In addition, flexibility provided by entanglement is present and nearly no viscous component is present, so adhesiveness to a transfer material weakens. Though the toner can withstand abrasion, however, the toner tends to be weak against peeling. In particular, the toner is apt to peel off a transparency. When the peak top molecular weight MpA of the main peak is larger than 7,000, a half tone image and fixability to cardboard degrade. Furthermore, the dispersibility of a colorant, a release agent, or the like cannot be improved, with the result that durable developability at a high temperature and a high humidity degrades. In addition, when the peak top molecular weight MpB of the main peak of the THF soluble matter B of the toner is smaller than 5,000, the amount of a component having a low molecular weight and a low softening temperature relatively increases, so storage stability degrades. In addition, the amount of a component that is thermally unstable increases, so the toner is vulnerable to a mechanical shear, and the deterioration of the toner is apt to progress. As a result, it becomes difficult to obtain image quality stably for a long time period. When the peak top molecular weight MpB of the main peak is larger than 10,000, the amount of a component that tends to cause thermal behavior in a low temperature region relatively reduces, so fixability degrades. In addition, the amount of a component having strong brittleness relatively increases, so grindability is affected.

In addition, when the THF soluble matter B contains a component of a molecular weight region of 100,000 or less in range of less than 70 mass %, sufficient fixability cannot be achieved, and a crosslinked component capable of effectively taking in a component having a low molecular weight and a low softening temperature is hardly obtained.

In addition, the content of THF insoluble matter of a binder resin component upon extraction of the toner of the present invention for 16 hours is preferably 10 mass % to 50 mass %, more preferably 15 mass % to 50 mass %, or still more preferably 15 mass % to 45 mass %.

The THF insoluble matter has a reducing effect on the offset amount of the toner to a heating member such as a fixing roller when the toner is applied to a high-speed machine because the THF insoluble matter is a component effective in exerting good releasability from the heating member such as a fixing roller. When the content of the THF insoluble matter is less than 10 mass %, the above effect is hardly exerted. When the content exceeds 50 mass %, fixability degrades, and the dispersibility of a raw material into the toner degrades, so chargeability tends to be nonuniform. In addition, in the present invention, it is extremely important to control the amount of the THF insoluble matter in order that the toner of the present invention may exert a more excellent effect because the amount of a low-softening temperature component that affects fixation to be taken in largely depends on the amount of the THF insoluble matter.

As described above, a low softening component effective for fixation can be effectively taken in a resin without the degradation of storage stability by: using the constitutions of resin components in toner, that is, a polyester unit and a vinyl copolymer unit at a specific mixing ratio; identifying the resin components as a high-softening temperature resin and a low-softening temperature resin depending on a molecular weight and using only the high-softening temperature resin, or preferably the high-softening temperature resin and the low-softening temperature resin at a specific mixing ratio; and controlling the structure of a highly crosslinked part (gel). As a result, a toner which: enables low-temperature fixation irrespective of the constitution of a fixing unit; is excellent in offset resistance and storage stability; stably provides high image quality even when the toner is used at a high humidity or a low humidity; and does not cause any image failure with time.

(2) Toner Component (i) Binder Resin

The toner of the present invention contains a specific binder resin. The binder resin to be used in the present invention contains at least a polyester unit and a vinyl copolymer unit. In general, incorporating a polyester unit excellent in low-temperature fixability and a vinyl copolymer unit excellent in hot offset resistance and having high compatibility with a release agent into the toner facilitates the design of a highly crosslinked part capable of taking in a low softening component without degrading storage stability.

In order that the toner of the present invention may obtain a desired effect, the binder resin to be used in the toner (high-softening temperature resin) may be a mixture of the polyester unit and the vinyl copolymer unit, or may be a hybrid resin in which the polyester unit and the vinyl copolymer unit are chemically bound to each other. However, the binder resin is preferably a hybrid resin in which the polyester unit and the vinyl copolymer unit are chemically bound to each other because a resin having a long distance between crosslinking points and effective for entanglement can be easily designed.

A containing ratio of the polyester unit with the vinyl copolymer unit is preferably 50/50 to 90/10, or more preferably 60/40 to 90/10 (mass ratio). A content of the polyester unit of less than 50 mass % is not preferable because required low-temperature fixability cannot be obtained. A content of the polyester unit in excess of 90 mass % is not preferable not only because storage stability degrades, but also it becomes difficult to control the dispersed state of a release agent.

In addition, the binder resin preferably has a peak molecular weight Mpt by means of GPC of tetrahydrofuran (THF) soluble matter of 5,000 to 10,000, a weight average molecular weight Mwt of 5,000 to 300,000, and a ratio Mwt/Mnt of the weight average molecular weight Mwt to a number average molecular weight Mnt of 5 to 50. When the Mpt and the Mwt are small and a distribution is narrow, hot offset occurs. In addition, when the Mpt and the Mwt are large and a distribution is broad, required low-temperature fixability cannot be obtained.

In addition, the softening temperature of the binder resin measured by using a flow tester is preferably 120 to 145° C., or more preferably 120° C. to 135° C. in order to establish a balance between fixability and hot offset property.

In addition, the glass transition temperature of the binder resin is preferably 53 to 62° C. from the viewpoints of fixability and storage stability.

Such resin as described above may be used alone as the binder resin, or two or more kinds of binder resins different from each other in softening point may be used as a mixture. In that case, a resin having a low molecular weight and a low softening temperature which can be effectively taken in the resin is preferable. The resin having a low softening temperature preferably has a peak molecular weight MpL by means of GPC of tetrahydrofuran (THF) soluble matter of 2,000 to 8,000, a weight average molecular weight MwL of 5,000 to 50,000, and a ratio MwL/MnL of the weight average molecular weight MwL to a number average molecular weight MnL of 1 to 10. In addition, the softening temperature of the resin having a low softening temperature measured by using a flow tester is preferably 80 to 105° C., or more preferably 850C to 98° C. in order to establish a balance between storage stability and fixability.

In addition, the glass transition temperature of the binder resin is preferably 45 to 60° C., or more preferably 45 to 58° C. from the viewpoints of fixability and storage stability.

In addition, when those two kinds of resins are used as a mixture, a ratio of a high-softening temperature resin to a low-softening temperature resin is preferably 90/10 to 30/70, or more preferably 80/20 to 30/70 in mass ratio from the viewpoints of storage stability, the offset property of the toner, and the degree to which the low-softening temperature resin is taken in a highly crosslinked component.

The content of the binder resin in the toner of the present invention is preferably 40 to 80 mass %, or more preferably 45 to 80 mass % with respect to the toner.

Hereinafter, a monomer to be used in the polyester unit in the binder resin to be used in the present invention will be described.

Examples of the aliphatic dicarboxylic acid and derivative thereof which are used in a polyester unit to be used for the binder resin according to the present invention include: dicarboxylic acid represented by the formula of HOOC—$(CH_2)_n$—COOH[n=1 to 8], maleic acid, fumaric acid, citraconic acid, itaconic acid, glutaconic acid and derivatives thereof and acid anhydrides thereof. Examples of the dicarboxylic acid represented by the above formula include: oxalic acid, malonic acid, succinic acid, adipic acid. Of those, maleic acid, fumaric acid, alkenylsuccinic acid, and acid anhydrides thereof, and HOOC—$(CH_2)_n$—COOH[n=4 to 8] are preferable to obtain a flexible resin which is optimum for entanglement of molecules with a long distance between crosslinking points. Of those, adipic acid is particularly preferable.

In addition, examples of the aliphatic diol include: ethylene glycol, propylene glycol, 1,3-butanediol, 1,4-butanediol, 2,3-butanediol, diethylene glycol, triethylene glycol, 1,5-pentanediol, 1,6-hexanediol, neopentylglycol, and 2-ethy-1,3-hexanediol. 1,4-Butanediol is preferable.

Examples of the polycarboxylic acid of trihydric or more or anhydride thereof include: 1,2,4-benzenetricarboxylic acid or trimellitic acid, 1,2,4-cyclohexanetricarboxylic acid, 1,2,4-naphthalenetricarboxylic acid, and pyromellitic acid and anhydrides, lower alkyl ester, or the like thereof. Examples of the polyalcohol of trihydric or more include: 1,2,3-propanetriol, trimethylolpropane, hexanetriol, and pentaerythritol. However, 1,2,4-benzenetricarboxylic and the anhydride thereof are preferable.

Next, examples of a dihydric alcohol component to be used in the polyester unit include the above-mentioned aliphatic diols, hydrogenated bisphenol A or a bisphenol derivative represented by the following formula (i):

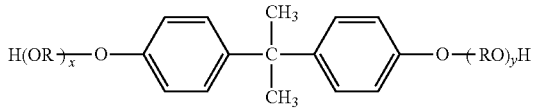

where R represents an ethylene or propylene group, x and y each represent an integer of 1 or more, and the average value of x+y is 2 to 10; and diols each represented by the following formula (ii):

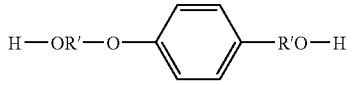

where R' represents —$CH_2CH_2$—, —$CH_2$—$CH(CH_3)$—, or —$CH_2$—$C(CH_3)_2$—.

In addition, examples of the dihydric carboxylic acid, in addition to the aliphatic dicarboxylic acid, include: aromatic dicarboxylic acids such as phthalic acid, terephthalic acid, isophthalic acid, and phthalic anhydride; and derivatives of the aromatic dicarboxylic acids.

The polyester unit to be used in the binder resin of the present invention can be produced by polymerizing at least one kind of such polyester monomers as described above by means of an ordinary method.

Examples of the vinyl monomer to be used for producing a vinyl copolymer unit to be used for a binder resin according to the present invention include styrene monomers and acrylate monomers as the following.

Examples of the styrene monomer include: styrenes such as styrene, o-methylstyrene, m-methylstyrene, p-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene; and derivatives thereof.

Examples of the acrylic acid monomer include: acrylic acids and acrylic esters such as acrylic acid, methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, and phenyl acrylate; α-methylene aliphatic monocarboxylic acids and esters thereof such as methacrylic acid, methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; and acrylate or methacrylate derivatives such as acrylonitrile, methacrylonitrile, and acrylamide.

Further, examples of the monomer of a vinyl copolymer unit include: acrylic esters or mathacrylic esters such as 2-hydroxylethylacrylate, 2-hydroxylethylmethacrylate, and 2-hydroxylpropyl methacrylate; and monomers each having a hydroxyl group such as 4-(1-hydroxy-1-methylbutyl) styrene and 4-(1-hydroxy-1-methylhexyl) styrene.

In the vinyl copolymer unit, if required, it is possible to use various monomers in combination as long as vinyl polymerization can be affected. Examples of such monomers include: ethylenically unsaturated monoolefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; and further, unsaturated dibasic acids such as maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride, and alkenylsuccinic anhydride; unsaturated basic acid half esters such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half ester, methyl fumarate half ester, and methyl mesaconate half ester; unsaturated basic acid esters such as dimethyl maleate and dimethyl fumarate; acid anhydrides of α,β-unsaturated acids such as acrylic acid, methacrylic acid, crotonic acid, and cinnamic acid; anhydrides of the above-mentioned α,β-unsaturated acids and lower aliphatic acids; and monomers each having a carboxyl group such as alkenylmalonic acid, alkenylglutaric acid, and alkenyladipic acid, and acid anhydrides thereof and monoesters thereof.

In addition, the vinyl copolymer unit may be a polymer crosslinked by a crosslinkable monomer to be exemplified below as required. Examples of the crosslinkable monomer include: aromatic divinyl compounds; diacrylate compounds connected by alkyl chains; diacrylate compounds connected by alkyl chains each containing an ether bond; diacrylate compounds connected by chains each containing an aromatic group and an ether bond; polyester type diacrylates; and polyfunctional crosslinking agents.

Examples of the aromatic divinyl compound include divinyl benzene and divinyl naphthalene.

Examples of the diacrylate compounds connected by alkyl chains include: ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and those obtained by changing the "acrylate" of the above-mentioned compounds to "methacrylate", and the like.

Examples of the diacrylate compounds connected by alkyl chains each containing an ether bond include: diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and those obtained by changing the "acrylate" of the above-mentioned compounds to "methacrylate", and the like.

Examples of the diacrylate compounds connected by chains each containing an aromatic group and an ether bond include: polyoxyethylene(2)-2,2-bis(4-hydroxyphenyl)propane diacrylate and polyoxyethylene(4)-2,2-bis(4-hydroxyphenyl)propane diacrylate; and those obtained by changing the "acrylate" of the above-mentioned compounds to "methacrylate", and the like.

An example of the polyester type diacrylates includes MANDA, trade name, manufactured by Nippon Kayaku Co., Ltd.

Example of the polyfunctional crosslinking agents include: pentaerythritol triacrylate, trimethylolethane triacrylate, trimethylolpropane triacrylate, tetramethylolmethane tetraacrylate, and oligoester acrylate; those obtained by changing the "acrylate" of the above-mentioned compounds to "methacrylate"; triallyl cyanurate; and triallyl trimellitate.

Each of those crosslinkable monomers can be used in an amount of preferably 0.01 to 10 parts by mass (or more preferably 0.03 to 5 parts by mass) with respect to 100 parts by mass of the other monomer components. In addition, examples of a monomer to be suitably used in terms of fixability and offset resistance out of those crosslinkable monomers include aromatic divinyl compounds (in particular, divinylbenzene) and diacrylate compounds connected by chains each containing an aromatic group and an ether bond.

The vinyl copolymer unit to be used in the binder resin of the present invention can be produced by polymerizing at least one kind of such vinyl copolymer units as described above by means of an ordinary method. In addition, the vinyl copolymer unit may be a resin produced by using any one of polymerization initiators. Each of those initiators is preferably used in an amount of 0.05 to 2 parts by mass with respect to 100 parts by mass of the monomer in terms of efficiency.

Examples of such polymerization initiators include: 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutylate, 1,1'-azobis(1-cyclohexanecarbonitrile), 2-carbamoylazoisobutyronitrile, 2,2'-azobis(2,4,4-trimethylpentane), 2-phenylazo-2,4-dimethyl-4-methoxyvaleronitrile, 2,2'-azobis(2-methylpropane), ketone peroxides such as methyl ethyl ketone peroxide, acetylacetone peroxide, and cyclohexanone peroxide, 2,2-bis(t-butylperoxy)butane, t-butyl hydroperoxide, cumene hydroperoxide, 1,1,3,3-tetramethylbutyl hydroperoxide, di-t-butyl peroxide, t-butylcumyl peroxide, dicumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-trioyl peroxide, diisopropyl peroxydicarbonate, di-2-ethylhexyl peroxydicarbonate, di-n-propyl peroxydicarbonate, di-2-ethoxyethyl peroxycarbonate, dimethoxyisopropyl peroxydicarbonate, di(3-methyl-3-methoxybutyl) peroxydicarbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butylperoxyisopropyl carbonate, di-t-butyl peroxyisophthalate, t-butyl peroxyallylcarbonate, t-amyl peroxy-2-ethylhexanoate, di-t-butyl peroxyhexahydroterephthalate, and di-t-butyl peroxyazelate.

A hybrid resin to be more preferably used as the binder resin in the present invention is a resin in which the polyester unit and the vinyl copolymer unit are chemically bound to each other directly and/or indirectly. The hybrid resin can be obtained by reacting a raw material monomer for the polyester unit and a raw material monomer for the vinyl copolymer unit simultaneously or sequentially.

In the present invention, the hybrid resin can be produced by: subjecting a raw material monomer for the polyester unit to a condensation polymerization reaction; polymerizing a vinyl copolymer unit monomer by using a polymerization initiator after the condensation polymerization reaction; and subjecting the vinyl copolymer unit to an addition polymerization reaction with an unsaturated or saturated polyester resin. Alternatively, the following method may be employed: after having been subjected to a condensation polymerization reaction, a raw material monomer for the polyester unit is dissolved into a solvent, and a vinyl copolymer unit monomer is polymerized on a first stage and the vinyl copolymer unit is subjected to an addition polymerization reaction with an unsaturated polyester resin on a second stage using a bifunctional polymerization initiator having reactive groups different from each other in decomposition temperature. The production of the hybrid resin by means of any one of those methods facilitates the design of a resin having a long distance between crosslinking points and effective for entanglement, so each of those methods is suitable for effectively taking a resin having a low softening temperature in a crosslinking structure. It should be noted that the hybrid resin can be produced by appropriately combining those methods.

The bifunctional polymerization initiator to be used for producing such hybrid resin is preferably, for example, the following initiator:

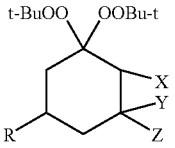

where t-Bu represents a t-butyl group, and X, Y, Z, and R each independently represent one selected from hydrogen, a methyl group, an ethyl group, a propyl group, a n-butyl group, an isopropyl group, an isobutyl group, and a t-butyl group.

Of those, each of 1,1-bis(t-butylperoxy)-2-methylcyclohexane, 1,1-bis(t-butylperoxy)-2-n-butylcyclohexane, and 1,1-bis(t-butylperoxy)-3,3,5-trimethylcyclohexane is the most preferable polymerization initiator in producing a highly crosslinked component whose molecules can be easily entangled.

The vinyl copolymer to be obtained as a result of the reaction on the first stage has a peak molecular weight (Mp) of preferably 10,000 to 100,000, more preferably 15,000 to 70,000, or still more preferably 20,000 to 60,000. When the Mp is less than 10,000, the frequency at which a highly crosslinked component is formed by entanglement reduces, so an effect on offset resistance reduces. Furthermore, the amount of a low softening component to be taken in the highly crosslinked component reduces, and the amount of a component that tends to cause thermal behavior in a low temperature region reduces, so a half tone image and fixability to cardboard degrade. When the Mp exceeds 100,000, addition polymerization reactivity with the unsaturated polyester resin on the second stage reduces, so the amount of a free vinylpolymer increases. Accordingly, the frequency at which a highly crosslinked component is formed by entanglement reduces, so an effect on offset resistance reduces.

The toner of the present invention contains a colorant as well as such binder resin as described above. Carbon black or at least one kind of the other conventionally known various pigments and dyes can be used as the colorant.

Examples of the dye include C.I. Direct Red I, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4, and C.I. Basic Green 6.

Example of the pigment include Chrome Yellow, Cadmium Yellow, Mineral Fast Yellow, Navel Yellow, Naphthol Yellow S. Hansa Yellow G, Permanent Yellow NCG, Tartrazine Lake, Chrome Orange, Molybdenum Orange, Permanent Orange GTR, Pyrazolone Orange, Benzidine Orange G, Cadmium Red, Permanent Red 4R, Watching Red Calcium Salt, Eosine Lake, Brilliant Carmine 3B, Manganese Purple, Fast Violet B, Methyl Violet Lake, Prussian Blue, Cobalt Blue, Alkali Blue Lake, Victoria Blue Lake, Phthalocyanine Blue, Fast Sky Blue, Indanthrene Blue BC, Chrome Green, Chrome Oxide, Pigment Green B, Malachite Green Lake, and Final Yellow Green G.

When the toner of the present invention is used for full color image-forming toner, the following colorants can be used. Examples of coloring pigments for magenta include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, and 209; C.I. Pigment Violet Red 19; and C.I. Vat Red 1, 2, 10, 13, 15, 23, 29, and 35.

Although each of the magenta pigments may be used alone, it is more preferable to combine the dye and the pigment to improve definition of an image, from the viewpoint of image quality of a full color image. Examples of the dye form agent a include: oil soluble dyes such as C.I. Solvent Red 1, 3, 8, 23, 24, 25, 27, 30, 49, 81, 82, 83, 84, 100, 109, and 121, C.I. Disperse Red 9, C.I. Solvent Violet 8, 13, 14, 21, and 27, and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, and 40 and C.I. Basic Violet 1, 3, 7, 10, 14, 15, 21, 25, 26, 27, and 28.

Examples of the coloring pigment for cyan include: C.I Pigment Blue 2, 3, 15, 16, and 17; C.I. Vat Blue 6; C.I. Acid Blue 45; and a copper phthalocyanine pigment in which a phthalocyanine skeleton having the following structure is substituted by 1 to 5 phthalimidemethyl groups.

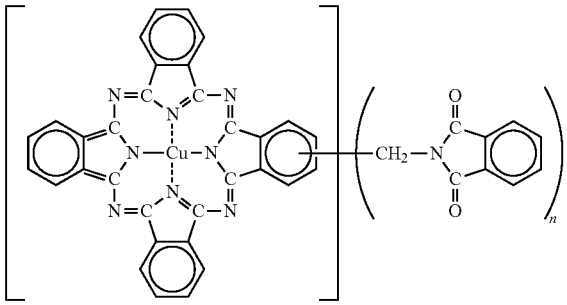

n=1 to 5

Examples of the coloring pigment for yellow include: C.I Pigment Yellow 1, 2, 3, 4, 5, 6, 7, 10, 11, 12, 13, 14, 15, 16, 17, 23, 35, 73, and 83; and C.I Vat yellow 1, 3, and 20.

The content of the colorant is preferably 0.1 to 60 parts by mass, or more preferably 0.5 to 50 parts by mass with respect to 100 parts by mass of the binder resin.

(ii) Optional Component

The toner of the present invention can contain an optional component that has been conventionally used in toner as well as the above essential ingredients.

The toner of the present invention can contain a release agent having a melting point specified by the temperature at which an endothermic peak is present upon temperature increase measured by using a differential scanning calorimeter (DSC) of 60 to 120° C. The melting point of the release agent is preferably 70 to 115° C. When the melting point is lower than 60° C., the viscosity of the toner reduces, a releasing effect reduces, and the contamination of a developing member or of a cleaning member due to duration occurs. When the melting point is higher than 120° C., required low-temperature fixability is hardly obtained.

The amount of the release agent to be added is preferably 1 to 20 parts by mass with respect to 100 parts by mass of the binder resin. When the amount is less than 1 part by mass, a desired releasing effect cannot be sufficiently obtained. When the amount exceeds 20 parts by mass, the dispersibility of the release agent in the toner is poor, and the adhesion of the toner to a photosensitive member, the contamination of the surface of a developing member or of a cleaning member, or the like occurs, with the result that a problem such as the deterioration of a toner image is apt to occur.

Examples of the release agent include: aliphatic hydrocarbon waxes such as low-molecular weight polyethylene, low-molecular weight polypropylene, a microcrystalline wax, and a paraffin wax; oxides of aliphatic hydrocarbon waxes such as a polyethylene oxide wax; block copolymers of the aliphatic hydrocarbon waxes; waxes mainly composed of fatty acid esters such as a carnauba wax, a sasol wax, and a montanic acid ester wax; and partially or wholly deacidified fatty acid esters such as a deacidified carnauba wax. The examples further include: saturated straight-chain fatty acids such as palmitic acid, stearic acid, montanic acid, and long-chain alkyl carboxylic acids each having an additionally long alkyl chain; unsaturated fatty acids such as brassidic acid, eleostearic acid, and parinaric acid; saturated alcohols such as stearyl alcohol, aralkyl alcohol, behenyl alcohol, carnaubyl alcohol, ceryl alcohol, melissyl alcohol, and long-chain alkyl alcohols each having an additionally long alkyl chain; polyhydric alcohols such as sorbitol; aliphatic metal salts (what are generally referred to as metallic soaps) such as calcium stearate, calcium laurate, zinc stearate, and magnesium stearate; waxes obtained by grafting aliphatic hydrocarbon waxes with vinyl monomers such as styrene and acrylic acid; partially esterified compounds of fatty acids and polyhydric alcohols such as behenic monoglyceride; methyl ester compounds each having a hydroxyl group obtained by the hydrogenation of vegetable oil; and long-chain alkyl alcohols or long-chain alkyl carboxylic acids each having 12 or more carbon atoms.

Examples of a release agent to be particularly preferably used in the present invention include aliphatic hydrocarbon waxes. The above examples of such aliphatic hydrocarbon waxes will be described in more detail. The examples include: a low-molecular weight alkylene polymer obtained by subjecting an alkylene to radical polymerization under high pressure or by polymerizing an alkylene under reduced pressure by using a Ziegler catalyst; an alkylene polymer obtained by thermal decomposition of a high-molecular weight alkylene polymer; a synthetic hydrocarbon wax obtained from a residue on distillation of a hydrocarbon obtained by means of an Age method from a synthetic gas containing carbon monoxide and hydrogen, and a synthetic hydrocarbon wax obtained by hydrogenation of the gas; and those obtained by fractionating those aliphatic hydrocarbon waxes by means of a press sweating method, a solvent method, or vacuum distillation or according to a fractional crystallization mode.

Examples of a hydrocarbon as a parent body of each of the above aliphatic hydrocarbon waxes include: one synthesized by a reaction between carbon monoxide and hydrogen using a metal oxide catalyst (a multiple system composed of two or more kinds in many cases) (such as a hydrocarbon compound synthesized by means of a synthol method or a hydrocol method (involving the use of a fluid catalyst bed)); a hydrocarbon having several hundred of carbon atoms obtained by means of an Age method (involving the use of an identification catalyst bed) with which a large amount of a wax-like hydrocarbon can be obtained; and a hydrocarbon obtained by polymerizing an alkylene such as ethylene by using a Ziegler catalyst. Of such hydrocarbons, in the present invention, a small, saturated, and long straight-chain hydrocarbon with a small number of branches is preferable, and a hydrocarbon synthesized by means of a method not involving the polymerization of an alkylene is particularly preferable because of its molecular weight distribution.

Specific examples of a release agent that can be used include: Biscol (trademark) 330-P, 550-P, 660-P, and TS-200 (Sanyo Chemical Industries, Ltd.) ; Hiwax 400P, 200P, 100P, 410P, 420P, 320P, 220P, 210P, and 110P (Mitsui Chemicals, Inc.); Sasol H1, H2, C80, C105, and C77 (Schumann Sasol); HNP-1, HNP-3, HNP-9, HNP-10, HNP-11, and HNP-12 (NIPPON SEIRO CO., LTD) ; Unilin (trademark) 350, 425, 550, and 700 and Unisid (trademark), Unisid (trademark) 350, 425, 550, and 700 (TOYO-PETROLITE); and a haze wax, a beeswax, a rice wax, a candelilla wax, and a carnauba wax (available from CERARICA NODA Co., Ltd.).

The time at which the release agent is added is appropriately selected from the existing methods. For example, the release agent may be added at the time of melting and kneading during toner production, or may be added at the time of the production of the binder resin. In addition, one kind of those release agents may be used alone, or two or more kinds of them may be used in combination.

The toner of the present invention may be a magnetic toner or a non-magnetic toner; provided that the toner of the present invention is preferably a magnetic toner in terms of, for example, durability in a high-speed machine.

Examples of the magnetic material used in the present invention include: magnetic iron oxides containing iron oxides such as magnetite, maghemite, and ferrite and other metal oxides; metals such as Fe, Co, and Ni, or alloys thereof with metals such as Al, Co, Pb, Mg, Ni, Sn, Zn, Sb, Be, Bf, Cd, Ca, Mn, Se, Ti, W, and V; and mixtures thereof. Conventionally, triiron tetraoxide ($Fe_3O_4$), iron sesquioxide ($\gamma$-$Fe_2O_3$), zinc iron oxide ($ZnFe_2O_4$), yttrium iron oxide ($Y_3Fe_5O_{12}$), cadmium iron oxide ($Cd_3Fe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co), nickel powder (Ni), and the like have been known. Particularly preferable magnetic material is fine powder of triion tetraoxide or $\gamma$-iron sesquioxide. Furthermore, each of the magnetic materials mentioned above can be selected and used alone, or two or more kinds thereof can be selected and used in combination.

Each of those magnetic materials preferably has magnetic properties in an applied magnetic field of 795.8 kA/m including: a coercive force Hc of 1.6 to 12.0 kA/m; a saturation magnetization as of 50 to 200 $Am^2$/kg (more preferably 50 to 100 $Am^2$/kg) ; and a residual magnetization car of 2 to 20 $Am^2$/kg. The magnetic properties of a magnetic material in, for example, an external magnetic field of 769 kA/m at 25° C. can be measured by using an oscillation sample type magnetometer such as a VSM P-1-10 (manufactured by Toei Industry Co., Ltd.).

The amount of the magnetic material to be added is preferably 10 to 200 parts by mass with respect to 100 parts by mass of the binder resin.

A charge control agent can be used in the toner of the present invention to stabilize the chargeability of the toner. A charge control agent is generally incorporated into toner particles in an amount of preferably 0.1 to 10 parts by mass, or more preferably 0.1 to 5 parts by mass with respect to 100 parts by mass of the binder resin, although the amount varies depending on, for example, the kind of the charge control agent and the physical properties of other materials constituting the toner particles. Known examples of such charge control agent include one for controlling toner to be negatively chargeable and one for controlling toner to be positively chargeable. At least one kind of various charge control agents can be used depending on the kind and applications of the toner.

For example, an organometallic complex or a chelate compound is an effective charge control agent for controlling toner to be negatively chargeable. Examples of such charge control agent for controlling toner to be negatively chargeable include: monoazo metal complexes; acetylacetone metal complexes; metal complexes or metal salts of aromatic hydroxycarboxylic acids or aromatic dicarboxylic acids. The examples of such charge control agent for controlling toner to be negatively chargeable further include: aromatic monocarboxylic and polycarboxylic acids, and metal salts and anhydrates of the acids; esters; and phenol derivatives such as bisphenol.

Examples of a charge control agent for controlling toner to be positively chargeable include: nigrosin and denatured products of nigrosin with aliphatic metal salts, and so on; quaternary ammonium salts such as tributylbenzyl ammonium-1-hydroxy-4-naphtosulfonate and tetrabutyl ammonium tetrafluoroborate, and analogs of the salts, which are onium salts such as phosphonium salts and lake pigments of the salts; triphenyl methane dyes and lake pigments of the dyes (lake agents include phosphotungstenic acid, phosphomolybdic acid, phosphotungsten molybdic acid, tannic acid, lauric acid, gallic acid, ferricyanic acid, and ferrocyanide); metal salts of higher aliphatic acids; diorganotin oxides such as dibutyltin oxide, dioctyltin oxide, and dicyclohexyltin oxide; and diorganotin borates such as dibutyltin borate, dioctyltin borate, and dicyclohexyltin borate. In the present invention, one kind of them may be used alone, or two or more kinds of them may be used in combination. Of those, a charge control agent for controlling toner to be positively chargeable made of a nigrosin compound, a quaternary ammonium salt, or the like is particularly preferably used.

Specific examples of a charge control agent that can be used for negative charging include: Spilon Black TRH, T-77, and T-95 (Hodogaya Chemical Co., Ltd.); and BONTRON (trademark) S-34, S-44, S-54, E-84, E-88, and E-89 (Orient Chemical Industries, LTD.). Examples of a charge control agent that can be preferably for positive charging include: TP-302 and TP-415 (Hodogaya Chemical Co., Ltd.); BONTRON (trademark) N-01, N-04, N-07, and P-51 (Orient Chemical Industries, LTD.); and Copy Blue PR (Clariant).

A charge control resin can also be used, and can be used in combination with any one of the above charge control agents.

The chargeability of the toner of the present invention may be either positive or negative; provided that the toner of the present invention is preferably a negatively chargeable toner because a polyester resin itself serving as the binder resin has high negative chargeability.

An inorganic fine powder may be used as a fluidity improver in the toner of the present invention. Any improver can be used as the fluidity improver as long as it can improve fluidity as compared to that before external addition to toner particles. Examples of such fluidity improver include: a fluorine resin powder such as a vinylidene fluoride fine powder or a polytetrafluoroethylene fine powder; fine powdered silica such as silica obtained through a wet process or silica obtained through a dry process; and treated silica obtained by treating the surface of the above silica with a silane coupling agent, a titanium coupling agent, silicone oil, or the like. A preferable fluidity improver is a fine powder produced through the vapor phase oxidation of a silicon halide compound, the fine powder being called dry process silica or fumed silica. That is, the dry process silica or fumed silica is produced by means of a conventionally known technique. For example, the production utilizes a thermal decomposition oxidation reaction in oxygen and hydrogen of a silicon tetrachloride gas, and a basic reaction formula for the reaction is represented by the following formula: $SiCl_4+2H_2+O_2 \rightarrow SiO_2+4HCl$.

A composite fine powder of silica and any other metal oxide can also be obtained by using a silicon halide compound with any other metal halide compound such as aluminum chloride or titanium chloride in the production step, and silica comprehends the composite fine powder as well. A silica fine powder having an average primary particle size in the range of preferably 0.001 to 2 μm, or particularly preferably 0.002 to 0.2 μm is desirably used.

Examples of a commercially available silica fine powder produced through the vapor phase oxidation of a silicon halide compound include those commercially available under the following trade names.

AEROSiL (NIPPON AEROSIL CO., LTD.)
AEROSiL 130
AEROSiL 200
AEROSiL 300
AEROSiL 380
AEROSiL TT600

AEROSiL MOX170
AEROSiL MOX80
AEROSiL COK84
Ca-O-SiL (CABOT Co.)
Ca-O-SiL M-5
Ca-O-SiL MS-7
Ca-O-SiL MS-75
Ca-O-SiL HS-5
Ca-O-SiL EH-5
Wacker HDK N 20 (WACKER-CHEMIE GMBH)
Wacker HDK N 20 V15
Waker HDK N 20 N20E
Wacker HDK N 20 T30
Waker HDK N 20 T40
D-CFine Silica (DOW CORNING Co.)
Fransol (Francil)

Furthermore, a treated silica fine powder obtained by subjecting the silica fine powder produced through the vapor phase oxidation of a silicon halide compound to a hydrophobic treatment is preferably used. The treated silica fine powder is particularly preferably obtained by treating the silica fine powder in such a manner that the degree of hydrophobicity titrated by a methanol titration test shows a value in the range of 30 to 80.

Hydrophobicity is imparted by chemically treating the silica fine powder with, for example, an organic silicon compound that reacts with, or physically adsorbs to, the silica fine powder. A preferable method involves treating the silica fine powder produced through the vapor phase oxidation of a silicon halide compound with an organic silicon compound. Examples of such organic silicon compound include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilylacrylate, vinyldimethylacetoxysilane, dimethylethoxysilane, dimethyldimethoxysilane, diphenyldiethoxysilane, 1-hexamethyldisiloxane, 1,3-divinyltetramethyldisiloxane, 1,3-diphenyltetramethyldisiloxane, and dimethylpolysiloxane which has having 2 to 12 siloxane units per molecule and contains a hydroxyl group bound to Si within a unit located in each of terminals. One of these compounds is used alone or mixture of two or more thereof is used.

The inorganic fine powder may be treated with silicone oil, or may be treated together with the above-mentioned hydrophobic treatment.

Silicone oil having a viscosity of 30 to 1,000 $mm^2/s$ at 25° C. is preferably used. Examples of preferable silicone oil include dimethyl silicone oil, methylphenyl silicone oil, α-methylstyrene-denatured silicone oil, chlorophenyl silicone oil, and fluorine-denatured silicone oil.

Examples a method for treatment with silicone oil that can be employed include: a method involving directly mixing a silica fine powder treated with a silane coupling agent and silicone oil by using a mixer such as a Henschel mixer; a method involving spraying a silica fine powder serving as a base with silicone oil; and a method involving dissolving or dispersing silicone oil into an appropriate solvent and adding and mixing a silica fine powder to and with the solution to remove the solvent. After silica has been treated with silicone oil, the temperature of the silica treated with silicone oil is more preferably heated to 200° C. or higher (still more preferably 250° C. or higher) in an inert gas so that the coat on the surface of silica is stabilized.

One of nitrogen atom-containing silane coupling agents such as aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutyaminopropyltrimethoxysilane, dioctylaminopropyldimethoxysilane, dibutylaminopropyldimethoxysilane, dibutylaminopropylmonomethoxysilane, dimethylaminophenyltriethoxysilane, trimethoxysilyl-γ-propylphenylamine, and trimethoxysilyl-γ-propylbenzylamine can be used individually or in combination. A preferable silane coupling agent includes hexamethyldisilazane (HMDS).

In the present invention, one obtained by means of a method involving treating silica with a coupling agent in advance and treating the resultant with silicone oil, or a method involving treating silica with a coupling agent and silicone oil simultaneously is preferable.

A fluidity improver having a specific surface area according to nitrogen adsorption measured by means of a BET method of 30 $m^2/g$ or more, or preferably 50 $m^2/g$ or more provides good results. The fluidity improver is desirably used in an amount of 0.01 to 8 parts by mass, or preferably 0.1 to 4 parts by mass with respect to 100 parts by mass of the toner particles.

In addition, any other external additive may be added to the toner of the present invention as required. Examples of such external additive include resin fine particles and inorganic fine particles serving as charging adjuvants, conductivity imparting agents, fluidity imparting agents, caking inhibitors, lubricants, and abrasives. For example, lubricants such as Teflon (trademark), zinc stearate, and polyvinylidene fluoride can be exemplified, and, of those, polyvinylidene fluoride is preferable. Alternatively, abrasives such as cerium oxide, silicon carbide, and strontium titanate can be exemplified, and, of those, strontium titanate is preferable. Alternatively, fluidity imparting agents such as titanium oxide and aluminum oxide can be exemplified, and, of those, a fluidity imparting agent which is hydrophobic is particularly preferable. Caking inhibitors, or conductivity imparting agents such as carbon black, zinc oxide, antimony oxide, and tin oxide may also be used. In addition, white and black fine particles opposite in polarity can be used in a small amount as a developability improver.

The usage of resin fine particles, an inorganic fine powder, a hydrophobic, inorganic fine powder, or the like to be mixed with the toner is preferably 0.1 to 5 parts by mass with respect to 100 parts by mass of the toner.

(iii) Methods of Measuring Physical Properties

Hereinafter, examples of methods of measuring physical properties according to the present invention will be shown.

[Measurement of THF Insoluble Matter]

About 1.0 g of a resin is weighed (W1 g). The weighed resin is placed into filter paper thimble (such as No. 86R size 28×10 mm, manufactured by ADVANTEC), and is subjected to a Soxhlet extractor so that the resin is extracted by using 200 ml of THF as a solvent for 16 hours. At this time, the extraction is performed at such a reflux rate that the extraction cycle of the solvent is once per about 4 to 5 minutes. After the completion of the extraction, the filter paper thimble is taken out and dried in a vacuum at 40° C. for 8 hours, and the extract residue is weighed (W2 g). Next, the weight of incineration ash in the toner is determined (W3 g). The weight of the incineration ash is determined through the following procedure. About 2 g of a sample are placed into a 30-ml magnetic crucible that has been precisely weighed in advance and are precisely weighed so that the mass (Wa g) of the sample is precisely weighed. The crucible is placed into an electric furnace, heated at about 900° C. for about 3 hours, left standing to cool in the electric furnace, and left standing to cool at normal temperature in a desiccator for 1 hours or longer before the mass of the crucible is precisely weighed. The weight (Wb g) of the incineration ash is determined from the following equation:

$$(Wb/Wa)\times 100=\text{Incineration ash content (mass \%)}.$$

The mass (W3 g) of the incineration ash of the sample can be determined from the content.

The content of THF insoluble matter is determined from the following equation:

$$\text{THF insoluble matter}=[W2-W3]/[W1-W3]\times 100\%.$$

It should be noted that the content of THF insoluble matter of a sample containing no component other than a resin such as a binder resin is determined by using a predetermined amount (W1 g) of the resin that has been weighed and the weight (W2 g) of an extract residue, which is determined through a step similar to that described above, from the following equation:

$$\text{THF insoluble matter}=W2/W1\times 100\%.$$

[Measurement of Molecular Weight Distribution by Means of GPC]

A column is stabilized in a heat chamber at 40° C. THF as a solvent is allowed to flow into the column at the temperature at a flow rate of 1 ml/min, and about 100 μl of a THF sample solution are injected for measurement. In measuring the molecular weight of the sample, the molecular weight distribution possessed by the sample was calculated from the relationship between a logarithmic value of an analytical curve prepared by several kinds of monodisperse polystyrene standard samples and the number of counts. Examples of standard polystyrene samples for preparing an analytical curve that can be used include samples each having a molecular weight of about $10^2$ to $10^7$. At least about ten standard polystyrene samples are suitably used. For example, TSK standard polystyrene (F-850, F-450, F-288, F-128, F-80, F-40, F-20, F-10, F-4, F-2, F-1, A-5000, A-2500, A-1000, A-500) manufactured by TOSOH CORPORATION can be used. In addition, an RI (refractive index) detector is used as a detector. It is recommended that a combination of multiple commercially available polystyrene gel columns are used as the column. Examples of the combination include: a combination of shodex GPC KF-801, 802, 803, 804, 805, 806, 807, and 800P (manufactured by Showa Denko K.K.); and a combination of TSK gel G1000H (HXL), G2000H (HXL), G3000H (HXL), G4000H (HXL), G5000H (HXL), G6000H (HXL), G7000H (HXL), and TSK guard column (manufactured by TOSOH CORPORATION).

In addition, the sample is produced as described below.

A sample is placed into THF, and the whole is left at 25° C. for several hours. After that, the resultant is sufficiently shaken and the sample is mixed with THF well (until the coalesced body of the sample disappears). Then, the resultant is left standing for an additional 12 hours. In this case, the time period for which the sample is left in THF is set to 24 hours. After that, the resultant is passed through a sample treatment filter (having a pore size of 0.2 to 0.5 μm, for example, a Myshori Disc H-25-2 (manufactured by TOSOH CORPORATION) can be used), and is regarded as a sample for GPC. In addition, a sample concentration is adjusted in such a manner that the concentration of a resin component is 0.5 to 5 mg/ml. A main peak in a molecular weight distribution obtained as a result of the measurement of the sample solution that has been left at 25° C. for 24 hours is defined as the MpB.

In addition, a solution extracted with THF obtained at the time of the THF insoluble matter measurement is passed through a sample treatment filter (having a pore size of 0.2 to 0.5 μm, for example, a Myshori Disc H-25-2 (manufactured by TOSOH CORPORATION) can be used), an disregarded as a sample for GPC. A main peak in a molecular weight distribution obtained as a result of the measurement is defined as the MpA.

[Particle Size Distribution of Magnetic Toner]

The particle size distribution of magnetic toner can be measured by means of any one of various methods. In the present invention, the measurement is performed by using a Coulter Counter. A Coulter Multisizer IIE (manufactured by Beckman Coulter, Inc) is used as a measuring device. An aqueous solution of NaCl having a concentration of about 1% prepared by using extra-pure sodium chloride is used as an electrolyte solution. For example, an ISOTON (R)-II (manufactured by Coulter Scientific Japan, Co.) can be used. A measurement method is as described below. 100 to 150 ml of the electrolyte aqueous solution are added with 0.1 to 5 ml of a surfactant (preferably an alkylbenzene sulfonate) as a dispersant. 2 to 20 mg of a measurement sample are added to the mixture. The electrolyte solution into which the sample has been suspended is subjected to a dispersion treatment by using an ultrasonic dispersing unit for about 1 to 3 minutes. The volume and number of toner particles are measured by using the measuring device with the aide of a 100-μm aperture as an aperture, and a volume distribution and a number distribution are calculated. At this time, the measured data is obtained in channels obtained by dividing the particle size range of 1.59 to 64.0 μm into 256 parts. The data obtained in the 256 channels is divided into 16 parts, a weight average particle size (D4) is determined from the volume distribution according to the present invention (the central value of each channel is defined as a representative value for the channel), a number average particle size (DI) is determined from the number distribution according to the present invention, the amount of a coarse powder (having a size of 10.1 μm or more) on a weight basis is determined from the volume distribution according to the present invention, and the number of fine powders (each having a size of 4.00 μm or less) on a number basis is determined from the number distribution according to the present invention.

[Method of Measuring Softening Point of Resin]

The term "softening point" as used herein refers to one measured by using a fall out type flow tester in conformance with JIS K7210. A specific measurement method is shown below. While 1 $cm^3$ of a sample is heated by using a fall out type flow tester (manufactured by Shimadzu Corporation) at a rate of temperature increase of 4° C./min, a load of 980 N $m^2$ (10 kg/$cm^2$) is applied to the sample by using a plunger to extrude a nozzle having a diameter of 1 mm and a length of 1 mm. A plunger fall out amount (flow value)-temperature curve is drawn on the basis of the result of the extrusion. The height of the S-shaped curve is denoted by h, and the temperature corresponding to h/2 (the temperature at which one half of a resin flows out) is defined as a softening point.

[Measurement of Glass Transition Temperature (Tg) of Resin and Melting Point of Wax]

A measuring device: Measurement is performed in accordance with ASTM D3418-82 by using a differential scanning calorimeter (DSC), an MDSC-2920 (manufactured by TA Instruments).

2 to 10 mg, preferably 3 mg, of a measurement sample are precisely weighed. The sample is placed into an aluminum pan, and measurement is performed in the measurement temperature range of 30 to 200° C. and at a rate of temperature increase of 10° C./min at normal temperature and a normal humidity by using an empty aluminum pan as a reference. Analysis is performed by using a DSC curve in the temperature range of 30 to 200° C. obtained in a second heating process.

A value obtained by analyzing the resultant DSC curve by means of a middle point method is used as a glass transition temperature (Tg). In addition, a value for the temperature at which an endothermic main peak is present in the resultant DSC curve is used as the melting point of wax.

(3) Production Method

The toner of the present invention can be produced by treating such binder resin having a specific constitution as described above, a colorant, any other additive, and the like in accordance with an ordinary method of producing toner. A specific method of producing the toner of the present invention involves: sufficiently mixing the above components by using a mixer such as a Henschel mixer or a ball mill; melting and kneading the mixture by using a heat kneader such as a heat roll, a kneader, or an extruder; cooling the kneaded product to solidify the kneaded product; grinding and classifying the solidified product; and sufficiently mixing a desired additive with the resultant by using a mixer such as a Henschel mixer as required.

Examples of a mixer include: a Henschel mixer (manufactured by Mitsui Mining Co., Ltd.); a Super mixer (manufactured by Kawata) ; a Ribocorn (manufactured by Okawara Corporation); a Nauta mixer, a Turbulizer, and a Cyclomix (manufactured by Hosokawa Micron Corporation) ; a Spiral pin mixer (manufactured by Pacific Machinery & and Engineering Co., Ltd.); and a Lodige mixer (manufactured by Matsubo Corporation).

Examples of a kneader include: a KRC kneader (manufactured by Kurimoto, Ltd.); a Buss co-kneader (manufactured by Buss); a TEM extruder (manufactured by Toshiba Machine Co., Ltd.); a TEX biaxial kneader (manufactured by Japan Steel Works Ltd.); a PCM kneader (manufactured by Ikegai); a Three-roll mill, a Mixing roll mill, and a Kneader (manufactured by Inoue Manufacturing Co., Ltd.); a Kneadex (manufactured by Mitsui Mining Co., Ltd.); an MS pressure kneader and a Kneader-ruder (manufactured by Moriyama Manufacturing Co., Ltd.); and a Banbury mixer (manufactured by Kobe Steels, Ltd.).

Examples of a grinder include: a Counter jet mill, a Micronjet, and an Inomizer (manufactured by Hosokawa Micron Corporation); an IDS mill and a PJM jet grinder (manufactured by Nippon Pneumatic Mfg, Co., Ltd.); a Cross jet mill (manufactured by Kurimoto, Ltd.); an Urumax (manufactured byNisso Engineering Co., Ltd.); an SK Jet OMill (manufactured by Seishin Enterprise Co., Ltd.); a Kryptron system (manufactured by Kawasaki Heavy Industries); a Turbo mill (manufactured by Turbo Kogyo Co., Ltd.); and a Super rotor (manufactured by Nisshin Engineering Inc.).

Examples of a classifier include: a Classiel, a Micron classifier, and a Spedic classifier (manufactured by Seishin Enterprise Co., Ltd.); a Turbo classifier (manufactured by Nisshin Engineering Inc.); a Micron separator, a Turboplex (ATP), and a TSP separator (manufactured by Hosokawa Micron Corporation); an Elbow jet (manufactured by Nittetsu Mining Co., Ltd.); a Dispersion separator (manufactured by Nippon Pneumatic Mfg, Co., Ltd.); and a YM microcut (manufactured by Yasukawa Shoji).

Examples of a sieving device (classifier) used for sieving coarse particles and the like include: an Ultrasonic (manufactured by Koei Sangyo Co., Ltd.); a Resonasieve and a Gyrosifter (manufactured by Tokuju Corporation); a Vibrasonic system (manufactured by Dalton Corporation); a Soniclean (manufactured by Shintokogio Ltd.); a Turbo screener (manufactured by Turbo Kogyo Co., Ltd.); a Microsifter (manufactured by Makino mfg Co., Ltd.); and a circular vibrating screen.

In addition, the toner particles of the present invention preferably have a weight average particle size of 3 to 9 μm in terms of, for example, image density and resolution.

The basic constitution and characteristics of the present invention have been described above. Hereinafter, the present invention will be specifically described on the basis of examples. However, an embodiment of the present invention is not limited by the examples at all. The term "part (s)" in any one of the examples refers to "part(s) by mass" unless otherwise stated.

<Production Example of Binder Resin 1>

A polyester monomer described in Table 1 was loaded into a four-necked flask, and the flask was mounted with a decompression device, a water separating device, a nitrogen gas introducing device, a temperature measuring device, and a stirring device. Then, in a nitrogen atmosphere, a temperature was increased to 230° C. before the content was subjected to a condensation polymerization reaction together with a polyester polymerization catalyst. After the completion of the reaction, the reactant was taken out of the container, cooled, and ground, whereby a polyester resin was obtained.

70 parts by mass of the polyester resin were loaded into the flask again, and the temperature was increased to 140° C. in such a manner that the resin would dissolve. After that, a mixture of 30 parts by mass of a vinyl copolymer monomer described in Table 1 and 0.2 part by mass of benzoyl peroxide as a polymerization initiator was dropped from a dropping funnel to the flask over 8 hours. The resultant was subjected to a reaction for 4 hours while the temperature was held at 140° C. After that, the resultant was distilled under reduced pressure at 180° C. over 4 hours, whereby the remaining monomer was removed, and, at the same time, hybridization due to a bond produced by a radical reaction between a styrene-acrylic resin and unsaturated polyester and an ester bond was performed. After the completion of the reaction, the reactant was taken out of the container, cooled, and ground, whereby Binder Resin 1 was obtained.

TABLE 1

| | | Monomer composition of polyester unit | | | | | | | | |
|---|---|---|---|---|---|---|---|---|---|---|
| | Polyester amount (parts by mass) | BPA-PO (mol %) | BPA-EO (mol %) | DSA (mol %) | TPA (mol %) | Adipic acid (mol %) | TMA (mol %) | FA (mol %) | Acrylic acid (mol %) | IPA (mol %) |
| Resin-1 | 70 | 52.3 | — | — | 7.8 | 14 | — | 1.8 | — | 24.1 |
| Resin-2 | 70 | 52.3 | — | — | 7.8 | 14 | — | 1.8 | — | 24.1 |
| Resin-3 | 70 | 52.3 | — | — | 17.5 | 5.7 | — | 0.5 | — | 24 |
| Resin-4 | 80 | 25 | 25 | — | 34 | 7 | 5 | — | 4 | — |
| Resin-5 | 80 | 22.5 | 27.2 | 2.5 | 40.5 | — | 4 | — | 3.3 | — |
| Resin-6 | 80 | 32.6 | 16.3 | 6.1 | 36.7 | — | 6.1 | — | 2.2 | — |
| Resin-7 | 80 | 2.6 | 50 | 5.3 | 26.3 | — | 8 | — | 7.8 | — |
| Resin-8 | 55 | 25 | 25 | 5 | 37.5 | — | 5 | 2.5 | — | — |
| Resin-9 | 80 | 52.6 | — | 2.6 | 39.5 | — | — | — | 5.3 | — |
| Resin-10 | 75 | 35 | 19.4 | — | 5.9 | — | 7 | 32.7 | — | — |
| Resin-11 | 90 | 40.8 | 20 | — | 25.9 | — | 0.6 | 12.7 | — | — |
| Resin-12 | 70 | 52.3 | — | — | 7.8 | 14 | — | 1.8 | — | 24.1 |
| Resin-13 | 70 | 52.3 | — | — | 7.8 | 14 | — | 1.8 | — | 24.1 |

| | | Monomer composition of styrene-acrylic unit | | | | | | | |
|---|---|---|---|---|---|---|---|---|---|
| | | | | | | Monomer composition for polymerization on first stage | | | |
| | Styrene-acrylic resin amount (parts by mass) | St | 2EHA | MBM | BA | Styrene-acrylic resin amount (parts by mass) | St | MBM | BA |
| Resin-1 | 30 | 21.9 parts by mass | — | 1.8 parts by mass | 6.3 parts by mass | — | — | — | — |
| Resin-2 | 15 | 10.35 parts by mass | — | 0.9 parts by mass | 3.75 parts by mass | 15 | 69 parts by mass | 6 parts by mass | 25 parts by mass |
| Resin-3 | 30 | 25 parts by mass | — | — | 5 parts by mass | — | — | — | — |
| Resin-4 | 20 | 86 mol % | 12 mol % | — | — | — | — | — | — |
| Resin-5 | 20 | 90 mol % | 8 mol % | — | — | — | — | — | — |
| Resin-6 | 20 | 88.8 mol % | 9.2 mol % | — | — | — | — | — | — |
| Resin-7 | 20 | 89.9 mol % | 8.1 mol % | — | — | — | — | — | — |
| Resin-8 | 45 | 93.4 mol % | — | — | 4.6 mol % | — | — | — | — |
| Resin-9 | 20 | 86.2 mol % | 11.8 mol % | — | — | — | — | — | — |
| Resin-10 | 25 | 7.5 parts by mass | 2.5 parts by mass | — | — | — | — | — | — |
| Resin-11 | 10 | 19 parts by mass | 6 parts by mass | — | — | — | — | — | — |
| Resin-12 | 30 | 10.35 parts by mass | — | 0.9 parts by mass | 3.75 parts by mass | 15 | 68 parts by mass | 8 parts by mass | 24 parts by mass |
| Resin-13 | 30 | 12.35 parts by mass | — | 0.9 parts by mass | 3.75 parts by mass | 13 | 69 parts by mass | 6 parts by mass | 25 parts by mass |

BPA-PO: Adduct of bisphenol A with propylene oxide,
BPA-EO: Adduct of bisphenol A with ethylene oxide,
DSA: Dodecenylsuccinic acid,
TPA: Terephthalic acid, Adipic acid
TMA: Trimellitic anhydride,
FA: Fumaric acid, Acrylic acid
IPA: Isophthalic acid,
St: Styrene,
2EHA: 2-ethylhexyl acrylate,
MBM: Monobutyl maleate,
BA: Butyl acrylate The physical properties of Binder Resin 1 are as shown in Table 2.

TABLE 2

| | Mp | Mw | Mw/Mn | THF insoluble matter | Softening point (° C.) | Tg (° C.) | |
|---|---|---|---|---|---|---|---|
| Resin-1 | 7450 | $3.77 \times 10^4$ | 10.63 | 27% | 120.0 | 54.5 | High-softening temperature resin |
| Resin-2 | 7780 | $3.53 \times 10^4$ | 8.41 | 29% | 124.9 | 53.7 | High-softening temperature resin |
| Resin-3 | 7298 | $0.82 \times 10^4$ | 2.81 | 0% | 101.0 | 59.2 | Low-softening temperature resin |
| Resin-4 | 8301 | $4.75 \times 10^4$ | 7.95 | 37% | 133.5 | 54.5 | High-softening temperature resin |
| Resin-5 | 3835 | $0.78 \times 10^4$ | 2.27 | 0% | 93.7 | 53.1 | Low-softening temperature resin |
| Resin-6 | 8021 | $10.4 \times 10^4$ | 9.97 | 40% | 144.5 | 62.0 | High-softening temperature resin |
| Resin-7 | 7873 | $0.85 \times 10^4$ | 3.54 | 0% | 100.2 | 54.2 | Low-softening temperature resin |
| Resin-8 | 7962 | $9.87 \times 10^4$ | 7.88 | 38% | 128.3 | 59.3 | High-softening temperature resin |
| Resin-9 | 4520 | $0.81 \times 10^4$ | 2.37 | 0% | 95.2 | 56.1 | Low-softening temperature resin |
| Resin-10 | 8351 | $10.5 \times 10^4$ | 10.11 | 36% | 137.4 | 57.3 | High-softening temperature resin |
| Resin-11 | 7995 | $0.88 \times 10^4$ | 2.45 | 0% | 102.3 | 60.9 | Low-softening temperature resin |
| Resin-12 | 7820 | $3.62 \times 10^4$ | 6.71 | 27% | 125.1 | 54.3 | High-softening temperature resin |
| Resin-13 | 7650 | $3.88 \times 10^4$ | 9.01 | 28% | 124.6 | 53.9 | High-softening temperature resin |

Mp: Peek molecular weight,
Mw: Weight average molecular weight,
Mw/Mn: Degree of dispersion,
Tg: Glass transition point <Production Example of Binder Resin 2>

200 parts by mass of xylene were loaded into a four-necked flask, and the inside of the container was sufficiently replaced with nitrogen while xylene was stirred. After that, a temperature was increased to 100° C. A mixed liquid of 100 parts by mass of a vinyl copolymer monomer (monomer for polymerization on a first stage) described in Table 1 and 2 parts by mass of 1,1-bis(t-butylperoxy)-2-methylcyclohexane as a bifunctional polymerization initiator was dropped to the flask over 4 hours at the temperature. After that, the resultant was held for 4 hours so that polymerization was complete. As a result, a styrene-acrylic polymer having peroxides at both terminals and having a peak molecular weight of 25,000 was obtained.

Next, a polyester monomer described in Table 1 was loaded into the four-necked flask together with a polymerization catalyst, and the flask was mounted with a decompression device, a water separating device, a nitrogen gas introducing device, a temperature measuring device, and a stirring device. Then, in a nitrogen atmosphere, the temperature was increased to 230° C. before the content was subjected to a condensation polymerization reaction. After the completion of the reaction, the reactant was taken out of the container, cooled, and ground, whereby a polyester resin was obtained.

70 parts by mass of the polyester resin were loaded into the flask again, and the temperature was increased to 120° C. in such a manner that the resin would dissolve. After that, a mixture of 15 parts by mass of a vinyl copolymer monomer described in Table 1, 15 parts by mass of the styrene-acrylic polymer having peroxides at both terminals obtained in advance, and 0.1 part by mass of benzoyl peroxide as a polymerization initiator was dropped from a dropping funnel to the flask over 1 hour. The resultant was subjected to a reaction for 7 hours while the temperature was held at 120° C. After that, a xylene solvent was removed by distillation under normal pressure, and then the remainder was distilled under reduced pressure at 180° C. over 4 hours, whereby the remaining monomer was removed, and, at the same time, hybridization due to a bond produced by a radical reaction between a styrene-acrylic resin and unsaturated polyester and an ester bond was performed. After the completion of the reaction, the reactant was taken out of the container, cooled, and ground, whereby Binder Resin 2 was obtained.

The physical properties of Binder Resin 2 are as shown in Table 2.

<Production Example of Binder Resin 3>

A polyester monomer described in Table 1 was loaded into a four-necked flask together with a polymerization catalyst, and the flask was mounted with a decompression device, a water separating device, a nitrogen gas introducing device, a temperature measuring device, and a stirring device. Then, in a nitrogen atmosphere, a temperature was increased to 230° C. before the content was subjected to a condensation polymerization reaction. After the completion of the reaction, the reactant was taken out of the container, cooled, and ground, whereby a polyester resin was obtained.

70 parts by mass of the polyester resin were loaded into the flask again, and the temperature was increased to 180° C. in such a manner that the resin would dissolve. After that, a mixture of 30 parts by mass of a vinyl copolymer monomer described in Table 1 and 0.2 part by mass of benzoyl peroxide as a polymerization initiator was dropped from a dropping funnel to the flask over 4.8 hours. The resultant was subjected to a reaction for 2 hours while the temperature was held at 180° C. After that, the resultant was distilled under reduced pressure at 150° C. over 3 hours, whereby the remaining monomer was removed, and, at the same time, hybridization due to an ester bond between a styrene-acrylic resin and polyester was performed. After the completion of the reaction, the reactant was taken out of the container, cooled, and ground, whereby Binder Resin 3 was obtained.

The physical properties of Binder Resin 3 are as shown in Table 2.

<Production Example of Binder Resin 4>

A polyester monomer described in Table 1 was loaded into a four-necked flask together with a polymerization catalyst, and the flask was mounted with a decompression device, a water separating device, a nitrogen gas introducing device, a temperature measuring device, and a stirring device. Then, in a nitrogen atmosphere, the content was stirred at 135° C. A mixture of a vinyl copolymer monomer described in Table 1 and 2 mol % of benzoyl peroxide as a polymerization initiator was dropped from a dropping funnel to the flask over 4 hours. After that, the resultant was subjected to a reaction at 135° C. for 5 hours. After that, the temperature was increased to 230° C. before the resultant was subjected to a condensation polymerization reaction. After the completion of the reaction, the reactant was taken out of the container, cooled, and ground, whereby Binder Resin 4 was obtained.

The physical properties of Binder Resin 4 are as shown in Table 2.

<Production Example of Binder Resin 5-9>

Each of Binder Resins 5-9 was obtained by using a monomer respectively described in Table 1 in the same manner as in Production Example of Binder Resin 4. The physical properties of the resins are as shown in Table 2.

<Production Example of Binder Resin 10>

Binder Resin 10 was obtained by using a monomer described in Table 1 in the same manner as in Production Example of Binder Resin 1. The physical properties of the binder resin are as shown in Table 2.

<Production Example of Binder Resin 11>

Binder Resin 11 was obtained by using a monomer described in Table 1 in the same manner as in Production Example of Binder Resin 3. The physical properties of the binder resin are as shown in Table 2.

<Production Example of Binder Resin 12>

Binder Resin 12 was obtained by using a monomer described in Table 1 in the same manner as in Production Example of Binder Resin 2 except that 1,1-bis(t-butylperoxy)-2-n-butylcyclohexane was used as a polymerization initiator. The physical properties of the binder resin are as shown in Table 2.

<Production Example of Binder Resin 13>

Binder Resin 13 was obtained by using a monomer described in Table 1 in the same manner as in Production Example of Binder Resin 2 except that 1,1-bis(t-butylperoxy)-3,3,5-trimethylcyclohexane was used as a polymerization initiator. The physical properties of the binder resin are as shown in Table 2.

EXAMPLE 1

| | |
|---|---|
| Binder Resin 1 | 70 parts by mass |
| Binder Resin 3 | 30 parts by mass |
| Magnetic iron oxide particles A (average particle size 0.14 μm, coercive force Hc = 11.5 kA/m, saturation magnetization σs = 90 $Am^2/kg$, residual magnetization σr = 16 $Am^2/kg$) | 90 parts by mass |
| Wax c | 4 parts by mass |
| Charge control agent-1 | 2 parts by mass |

The above materials were premixed by using a Henschel mixer. After that, the mixture was melted and kneaded by using a biaxial kneading extruder. At this time, a residence time was controlled in such a manner that the temperature of the kneaded resin would be 150° C.

The resultant kneaded product was cooled and coarsely ground by using a hammer mill. After that, the coarsely ground product was ground by using a turbo mill, and the resultant finely ground powder was classified by using a multi-division classifier utilizing a Co and a effect, whereby toner particles having a weight average particle size of 7.3 μm were obtained. 1.0 part by mass of a hydrophobic silica fine powder (BET 140 $m^2/g$) and 3.0 parts by mass of strontium titanate were externally added to and mixed with 100 parts by mass of the toner particles, and the mixture was sieved by using a mesh having an aperture of 150 μm, whereby Toner 1 was obtained.

Tables 3 and 4 show the internal addition formulation and physical property values of toner. The structure of the charge control agent is shown below.

TABLE 3

| | Composition | Melting point (° C.) |
|---|---|---|
| Wax a | Low-molecular weight polypropylene | 130 |
| Wax b | Paraffin wax | 75 |
| Wax c | Fischer-Tropsch wax | 105 |

TABLE 4

| | Example-1 | Example-2 | Example-3 | Example-4 | Example-5 | Example-6 | Example-7 | Example-8 | Example-9 |
|---|---|---|---|---|---|---|---|---|---|
| Toner No. | 1 | 2 | 3 | 4 | 5 | 6 | 7 | 8 | 9 |
| Binder resin (a) | Resin-1 | Resin-2 | Resin-2 | Resin-4 | Resin-4 | Resin-2 | Resin-4 | Resin-12 | Resin-13 |
| Binder resin (b) | Resin-3 | Resin-3 | — | Resin-5 | Resin-5 | Resin-5 | Resin-3 | Resin-3 | Resin-3 |
| Resin containing mass ratio (a)/(b) | 70/30 | 70/30 | 100/0 | 70/30 | 40/60 | 80/20 | 50/50 | 70/30 | 70/30 |
| Charge control agent | (1) | (3) | (1) | (3) | (3) | (1) | (2) | (3) | (3) |
| Wax | c | b | c | b | b | c | a | b | b |

TABLE 4-continued

| | | | | | | | | | |
|---|---|---|---|---|---|---|---|---|---|
| Magnetic iron oxide particles | A | A | A | A | A | A | A | A | A |
| Peak moleculer weight MpB | 6155 | 7335 | 6638 | 5907 | 5102 | 7245 | 8016 | 7250 | 7430 |
| Quantity of a component of molecular weight region of 100,000 cc less of THF soluble matter B (%) | 82 | 77 | 83 | 79 | 90 | 71 | 87 | 78 | 75 |
| Peak molecular weight MpA | 3210 | 5135 | 4785 | 3377 | 3360 | 6893 | 4754 | 5220 | 5150 |
| MpA/MpB | 0.52 | 0.70 | 0.85 | 0.57 | 0.66 | 0.92 | 0.93 | 0.72 | 0.69 |
| THF insoluble matter of toner (wt %) | 14.0 | 20.5 | 23.5 | 25.7 | 12.1 | 16.9 | 18.9 | 21.5 | 20.8 |

| | Comparative example-1 | Comparative example-2 | Comparative example-3 | Comparative example-4 |
|---|---|---|---|---|
| Toner No. | 10 | 11 | 12 | 13 |
| Binder resin (a) | Resin-6 | Resin-8 | Resin-10 | Resin-9 |
| Binder resin (b) | Resin-7 | Resin-9 | Resin-11 | — |
| Resin containing mass ratio (a)/(b) | 60/40 | 60/40 | 70/30 | 100/0 |
| Charge control agent | (1) | (2) | (2) | (1) |
| Wax | a | a | a | c |
| Magnetic iron oxide particles | A | A | A | A |
| Peak moleculer weight MpB | 6125 | 6328 | 6455 | 7855 |
| Quantity of a component of molecular weight region of 100,000 cc less of THF soluble matter B (%) | 74 | 88 | 69 | 66 |
| Peak molecular weight MpA | 5846 | 6149 | 6238 | 7748 |
| MpA/MpB | 0.95 | 0.97 | 0.97 | 0.99 |
| THF insoluble matter of toner (wt %) | 32.5 | 27.8 | 16.6 | 12.5 |

TABLE 4-continued

Charge control agent-1

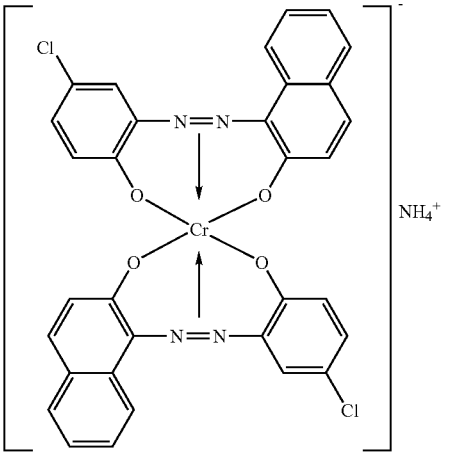

Charge control agent-2

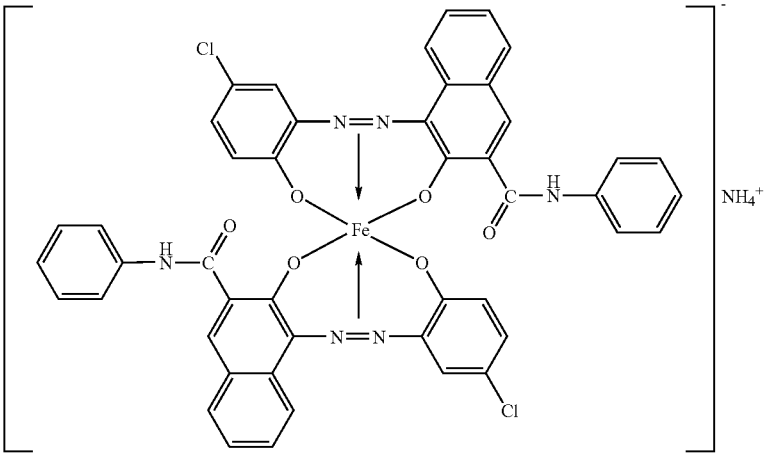

Charge control agent-3

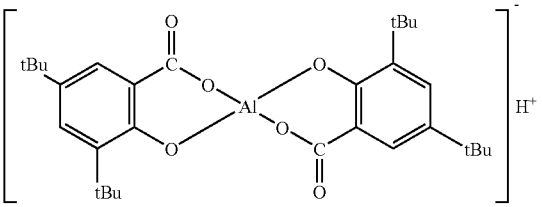

Toner 1 was evaluated for fixability, offset resistance, and OHT fixability by using an external fixing unit obtained by: removing a fixing unit (heat roller fixing unit) of a commercially available copying machine (IR-105 manufactured by Canon Inc.) to the outside; and reconstructing the fixing unit in such a manner that the fixing unit could operate even outside the copying machine, and the temperature of a fixing roller, a process speed, and an applied pressure could be arbitrarily set.

Two kinds of unfixed images, that is, a solid black image and a half tone image, on 90 g/m$^2$ paper were transported under conditions including a process speed of 600 mm/sec, a roller temperature of 150° C., and an applied pressure of 30 kgf/cm$^2$, and the fixed images were each rubbed with lens-cleaning paper. Evaluation for fixability was performed on the basis of a rate of reduction (%) in image density before and after the rubbing.

The evaluation criteria for fixability are as described below.

A (good): The rate of reduction is less than 10%.

B (acceptable): The rate of reduction is 10% or more and less than 20%.

C (inferior): The rate of reduction is 20% or more.

Table 5 shows the results of the evaluation.

TABLE 5

Results of evaluation for fixability

| | Solid black fixability | Half tone fixability | OHT fixability | Offset resistance | Storage stability |
|---|---|---|---|---|---|
| Example 1 | A/A | A/A | B/B | B/A | B |
| Example 2 | A/A | A/A | A/A | A/A | A |
| Example 3 | A/A | A/A | A/A | A/A | A |
| Example 4 | A/A | A/A | A/A | A/A | A |
| Example 5 | A/A | A/A | A/A | A/A | A |
| Example 6 | B/A | B/A | B/A | A/A | C |
| Example 7 | A/B | B/B | B/B | A/A | A |
| Example 8 | A/A | A/A | A/A | A/A | A |
| Example 9 | A/A | A/A | A/A | A/A | A |
| Comparative example 1 | B/C | C/C | B/C | A/A | A |
| Comparative example 2 | C/C | C/C | C/C | A/B | A |
| Comparative example 3 | C/C | C/C | C/C | B/B | A |
| Comparative example 4 | B/B | B/C | B/C | C/C | C |

Heat roller fixing unit/low-power consumption fixing unit

An unfixed image having an image area ratio of about 5% on 50 g/m$^2$ paper was transported under conditions including a process speed of 50 mm/sec, a roller temperature of 240° C., and an applied pressure of 50 kgf/cm$^2$. Evaluation for offset resistance was performed on the basis of the degree of contamination on the fixed image.

The evaluation criteria for offset resistance are as described below.

A: Good

B: Slight contamination occurs.

C: Contamination affecting an image occurs.

Table 5 shows the results of the evaluation.

A solid black unfixed image was transported by using an OHP film type A for PPC (manufactured by Canon Inc.) under conditions including a process speed of 600 mm/sec, a roller temperature of 180° C., and an applied pressure of 50 kgf/cm$^2$, and the fixed image was rubbed with lens-cleaning paper. Evaluation for OHT fixability was performed on the basis of a rate of reduction (%) in image density before and after the rubbing.

The evaluation criteria for OHT fixability are as described below.

A (good): The rate of reduction is less than 10%.

B (acceptable): The rate of reduction is 10% or more and less than 20%.

C (inferior): The rate of reduction is 20% or more.

Table 5 shows the results of the evaluation.

In addition, evaluation for each of fixability, offset resistance, and OHT fixability was performed by using an external fixing unit obtained by: removing, to the outside, a fixing unit (low-power consumption fixing unit) of a commercially available LBP printer (Laser Jet 4300, manufactured by HP) using a fixing device composed of an applied pressure member for causing a recording material to adhere to a heating body closely via a film; and reconstructing the fixing unit in such a manner that the fixing unit could operate even outside the printer, the temperature of a fixing film could be arbitrarily set, and a process speed would be 350 mm/sec.

Two kinds of unfixed images, that is, a solid black image and a half tone image, on 75 g/m$^2$ paper were transported at a heating body temperature of 140° C., and the fixed images were each rubbed with lens-cleaning paper. Evaluation for fixability was performed on the basis of a rate of reduction (%) in image density before and after the rubbing. The evaluation criteria are as described above. Table 5 shows the results of the evaluation.

An unfixed image having an image area ratio of about 5% on 50 g/m$^2$ paper was transported at a heating body temperature of 240° C. Evaluation for offset resistance was performed on the basis of the degree of contamination on the fixed image. The evaluation criteria are as described above. Table 5 shows the results of the evaluation.

A solid black unfixed image was transported by using an OHP film type A for PPC (manufactured by Canon Inc.) under conditions including a heating body temperature of 170° C. and an applied pressure of 50 kgf/cm$^2$, and the fixed image was rubbed with lens-cleaning paper. Evaluation for OHT fixability was performed on the basis of a rate of reduction (%) in image density before and after the rubbing. The evaluation criteria are as described above. Table 5 shows the results of the evaluation.

In addition, evaluation for storage stability was performed as described below. 10 g of toner were weighed and placed into a 50-cc polycup. The polycup was left in a thermostat at 50° C. for 7 days while a weight of 50 g was applied. Visual evaluation for blocking property after that was performed by using the following evaluation criteria.

○: The toner does not aggregate at all.

○Δ: The aggregate of the toner can be collapsed by rotating the cup.

Δ: The aggregate of the toner is present, but the aggregate is gradually reduced and collapsed as the cup is rotated.

Δ×: The aggregate of the toner remains even after the cup has been rotated.

×: The aggregate of the toner is large, and cannot be collapsed even by rotating the cup.

Table 5 shows the results of the evaluation.

A commercially available copying machine (IR-6010 manufactured by Canon Inc.) was reconstructed in such a manner that a process speed would be 410 mm/sec. 200,000-sheet continuous printing test for Toner 1 was performed by using a test chart having a printing ratio of 4% in each of an environment at 23° C. and 5% RH, an environment at 23° C. and 60% RH, and an environment at 32° C. and 80% RH, whereby evaluation for each of image density and fogging was performed.

The reflection density of a 5-mm square image was measured by using an SPI filter in a Macbeth densitometer (manufactured by Gretag Macbeth). Tables 6 to 8 show the results of the evaluation for image density.

TABLE 6

Results of evaluation of each toner at high temperature and high humidity (32° C., 80% RH)

| | Initial stage | | After 200,000-sheet duration | |
|---|---|---|---|---|
| | Density | Fogging | Density | Fogging |
| Example 1 | 1.40 | 0.5 | 1.35 | 0.7 |
| Example 2 | 1.42 | 0.9 | 1.41 | 1.1 |
| Example 3 | 1.43 | 0.4 | 1.41 | 0.6 |
| Example 4 | 1.41 | 1.1 | 1.41 | 1.2 |
| Example 5 | 1.49 | 0.8 | 1.47 | 1.1 |
| Example 6 | 1.40 | 1.2 | 1.36 | 1.3 |
| Example 7 | 1.39 | 1.2 | 1.35 | 1.4 |
| Example 8 | 1.41 | 1.0 | 1.40 | 1.2 |
| Example 9 | 1.43 | 0.8 | 1.42 | 0.9 |
| Comparative example 1 | 1.41 | 1.8 | 1.32 | 2.2 |

TABLE 6-continued

| Results of evaluation of each toner at high temperature and high humidity (32° C., 80% RH) | | | | |
|---|---|---|---|---|
| | Initial stage | | After 200,000-sheet duration | |
| | Density | Fogging | Density | Fogging |
| Comparative example 2 | 1.35 | 2.5 | 1.22 | 3.3 |
| Comparative example 3 | 1.32 | 2.4 | 1.15 | 3.5 |
| Comparative example 4 | 1.22 | 1.5 | 1.05 | 3.8 |

TABLE 7

| Results of evaluation of each toner at normal temperature and normal humidity (23° C., 60% RH) | | | | |
|---|---|---|---|---|
| | Initial stage | | After 200,000-sheet duration | |
| | Density | Fogging | Density | Fogging |
| Example 1 | 1.41 | 0.8 | 1.36 | 1.1 |
| Example 2 | 1.43 | 1.1 | 1.43 | 1.5 |
| Example 3 | 1.43 | 0.9 | 1.42 | 1.3 |
| Example 4 | 1.40 | 1.3 | 1.39 | 1.2 |
| Example 5 | 1.50 | 0.9 | 1.47 | 1.1 |
| Example 6 | 1.41 | 1.1 | 1.40 | 1.4 |
| Example 7 | 1.42 | 1.4 | 1.43 | 1.7 |
| Example 8 | 1.41 | 1.2 | 1.41 | 1.3 |
| Example 9 | 1.43 | 1.3 | 1.42 | 1.5 |
| Comparative example 1 | 1.42 | 2.1 | 1.35 | 2.5 |
| Comparative example 2 | 1.38 | 2.6 | 1.33 | 2.9 |
| Comparative example 3 | 1.33 | 2.4 | 1.25 | 2.8 |
| Comparative example 4 | 1.22 | 1.3 | 1.14 | 2.7 |

TABLE 8

| Results of evaluation of each toner at normal temperature and low humidity (23° C., 5% RH) | | | | |
|---|---|---|---|---|
| | Initial stage | | After 200,000-sheet duration | |
| | Density | Fogging | Density | Fogging |
| Example 1 | 1.40 | 1.5 | 1.35 | 1.1 |
| Example 2 | 1.40 | 1.1 | 1.39 | 1.6 |
| Example 3 | 1.41 | 1.6 | 1.41 | 1.4 |
| Example 4 | 1.42 | 1.4 | 1.42 | 1.5 |
| Example 5 | 1.48 | 1.2 | 1.49 | 1.2 |
| Example 6 | 1.42 | 1.5 | 1.41 | 1.7 |
| Example 7 | 1.44 | 1.1 | 1.42 | 2.1 |
| Example 8 | 1.41 | 1.2 | 1.40 | 1.5 |
| Example 9 | 1.43 | 1.4 | 1.41 | 1.7 |
| Comparative example 1 | 1.38 | 2.3 | 1.33 | 2.9 |
| Comparative example 2 | 1.41 | 2.8 | 1.38 | 3.1 |
| Comparative example 3 | 1.32 | 2.5 | 1.22 | 3.3 |
| Comparative example 4 | 1.29 | 2.3 | 1.08 | 3.8 |

Density measurement was performed by using a reflection densitometer (REFLECTOMETER MODEL TC-6DS manufactured by Tokyo Denshoku). The worst value of the reflection density of a white ground portion after image formation was denoted by Ds, and the average reflection density of a transfer material before the image formation was denoted by Dr. Evaluation for fogging was performed on the basis of a value for Ds−Dr as a fogging amount. The lower the value, the better the suppression of fogging. The evaluation was performed at an initial stage (first sheet) and on a 200,000th sheet. Tables 6 to 8 show the results of the evaluation.

EXAMPLES 2 to 9

Each of Toners 2 to 9 was produced in the same manner as in Example 1 in accordance with the formulation of each of Examples 2 to 9 described in Table 4. Table 4 shows the physical property values of Toners 2 to 9 obtained. Table 5 shows the results of a test for each of fixability, offset resistance, OHT fixability, and storage stability performed in the same manner as in Example 1. Tables 6 to 8 show the results of a continuous printing test performed in the same manner as in Example 1.

EXAMPLES 1 to 4

Each of Toners 1 to 4 was produced in the same manner as in Example 1 in accordance with the formulation of each of Examples 10 to 13 described in Table 4. Table 4 shows the physical property values of Toners 10 to 13 obtained. Table 5 shows the results of a test for each of fixability, offset resistance, OHT fixability, and storage stability performed in the same manner as in Example 1. Tables 6 to 8 show the results of a continuous printing test performed in the same manner as in Example 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims from the benefit of Japanese Patent Laid-Open No. 2005-223298, filed Aug. 1, 2005, which is hereby incorporated by reference herein in its entirety.

What is claimed is:

1. A toner comprising at least:

a binder resin; and a colorant, wherein:

the binder resin contains at least a polyester unit and a vinyl copolymer unit;

a main peak MpA is present in a molecular weight region of 2,000 to 7,000 in a molecular weight distribution measured by means of gel permeation chromatography (GPC) of a tetrahydrofuran (THF) soluble matter A when the toner is extracted through Soxhlet extraction with THF for 16 hours;

a main peak MpB is present in a molecular weight region of 5,000 to 10,000 in a molecular weight distribution measured by means of GPC of a THF soluble matter B when the toner is left in a THF solvent at 25° C. for 24 hours, and the THF soluble matter B contains a component of a molecular weight region of 100,000 or less in range from 70 to 100 mass %; and a peak molecular weight MpA of the THF soluble matter A and a peak molecular weight MpB of the THF soluble matter B satisfy the following equation:

$$0.50<MpA/MpB<0.95,$$

wherein the binder resin comprises a hybrid resin in which the polyester unit and the vinyl copolymer unit are chemically bound to each other, wherein the hybrid resin is obtained by polymerizing a vinyl monomer to produce the vinyl copolymer unit on a first stage and reacting the vinyl copolymer unit and an unsaturated polyester unit on a second stage using a bifunctional polymerization initiator having reactive groups different from each other in decomposition temperature and wherein the unsaturated polyester unit is produced employing a dicarboxylic acid of the formula HOOC—$(CH_2)_n$—COOH, where n is 4-8.

2. A toner according to claim 1, wherein the bifunctional polymerization initiator has the following structure:

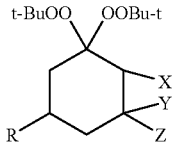

where t-Bu represents a t-butyl group, and X, Y, Z, and R each independently represent one selected from the group consisting of hydrogen, a methyl group, an ethyl group, a propyl group, a n-butyl group, an isopropyl group, an isobutyl group, and a t -butyl group.

3. A toner according to claim 1, wherein the bifunctional polymerization initiator comprises one kind selected from the group consisting of 1,1-bis(t-butylperoxy)-2-methylcyclohexane, 1,1-bis (t-butylperoxy)-2-n -butylcyclohexane, and 1,1-bis(t-butylperoxy)-3,3,5-trimethylcyclohexane.

* * * * *